United States Patent [19]

Stachowiak

[11] Patent Number: 4,602,740

[45] Date of Patent: Jul. 29, 1986

[54] FLUID CONTROL SYSTEM

[76] Inventor: J. Edward Stachowiak, 12628 Broken Bough, Houston, Tex. 77024

[21] Appl. No.: 433,840

[22] Filed: Oct. 12, 1982

[51] Int. Cl.[4] ..... B05B 1/14

[52] U.S. Cl. ..... 239/124; 137/882; 239/447; 251/333

[58] Field of Search ..... 239/124, 443–447; 137/861, 882, 883; 251/322, 323, 333

[56] References Cited

U.S. PATENT DOCUMENTS

| | | | |
|---|---|---|---|
| 2,308,347 | 1/1943 | Asselin . | |
| 3,181,474 | 5/1965 | Yohpe . | |
| 3,614,060 | 10/1971 | Freed . | |
| 3,672,575 | 6/1972 | Hinrichs . | |
| 3,679,332 | 7/1972 | Yohpe . | |
| 3,698,422 | 10/1972 | Freed et al. . | |
| 3,802,628 | 4/1974 | Goss et al. | 239/445 X |
| 3,885,739 | 5/1975 | Tuttle . | |
| 3,986,523 | 10/1976 | Pacht . | |
| 4,017,576 | 4/1977 | Freed et al. . | |
| 4,136,854 | 1/1979 | Ehmig et al. | 251/333 |
| 4,349,154 | 9/1982 | Pacht | 239/124 |

*Primary Examiner*—Andres Kashnikow
*Attorney, Agent, or Firm*—Dodge, Bush & Moseley

[57] ABSTRACT

Fluid blast control apparatus for use in controlling a high pressure fluid in a fluid blast system, the apparatus including a body portion having an inlet for a source of fluid at high pressure, having a discharge outlet for the discharge of fluid at high pressure, having a dump outlet for the discharge of fluid at low pressure, and having a control chamber to place the dump outlet in communication with the inlet and the discharge outlet; a valve guide housing removably positioned in the flow chamber, the valve guide housing having a housing bore for housing a valve closure member, having guide means for guiding such a valve closure member during displacement thereof relatively to the valve guide housing, and having a valve seat; and a valve closure member housed in the housing bore, the valve closure member having a closure seat, and the valve closure member being adapted to be displaced relatively to the valve guide housing into a closed position for the closure seat to seat on the valve seat to control flow through the dump outlet.

48 Claims, 6 Drawing Figures

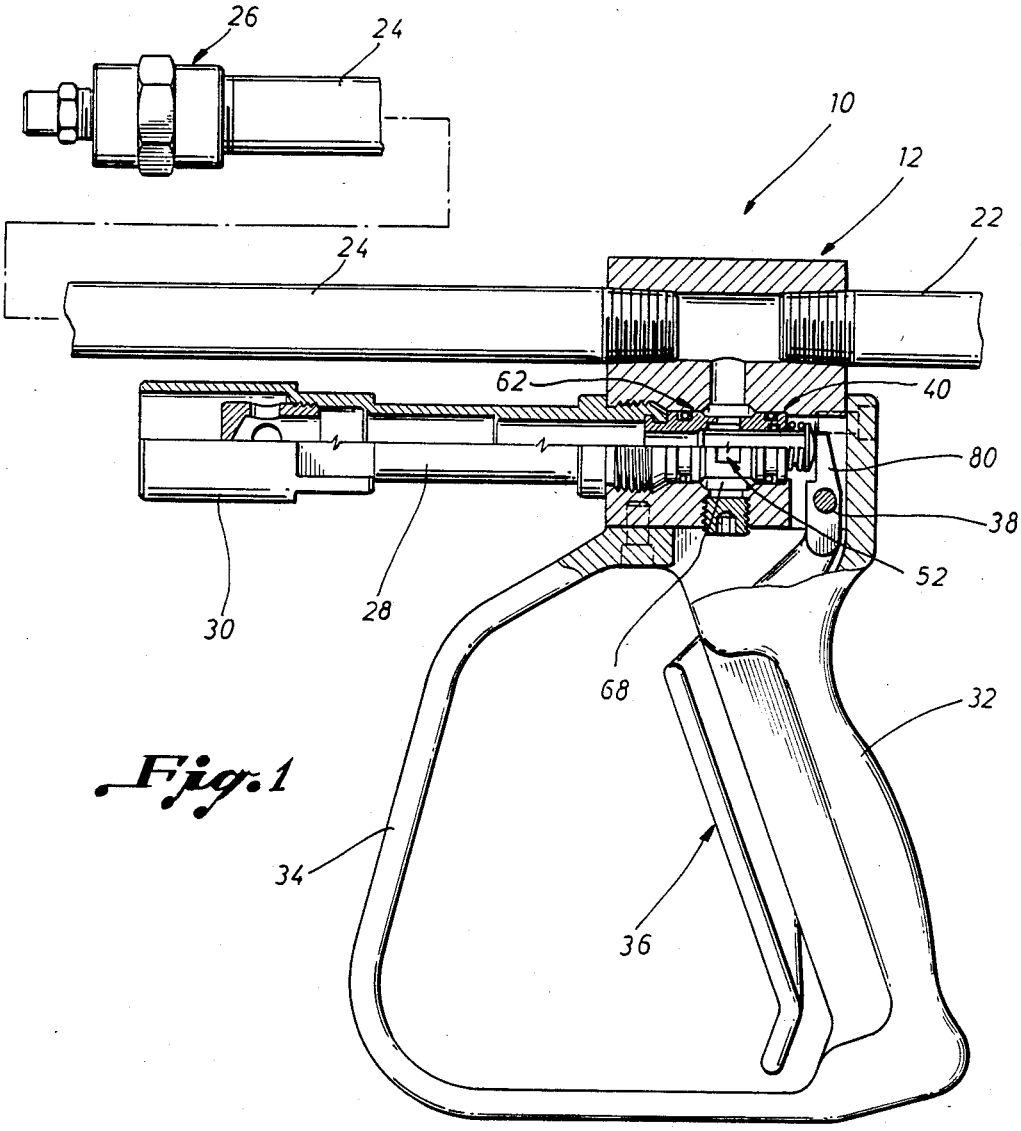
Fig. 1
Fig. 6
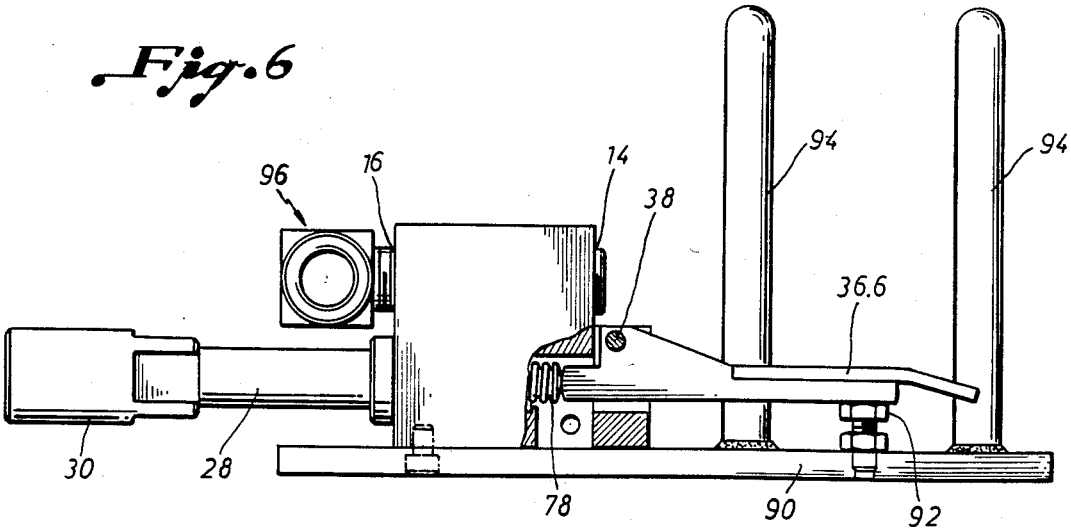

Fig. 3
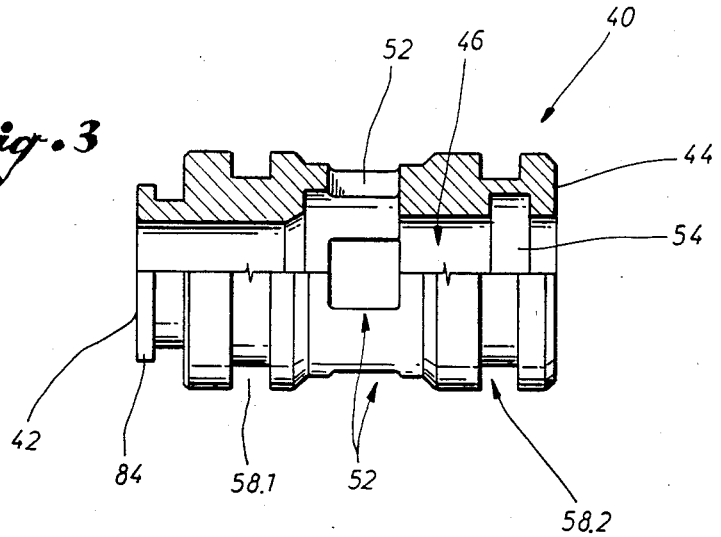
Fig. 4
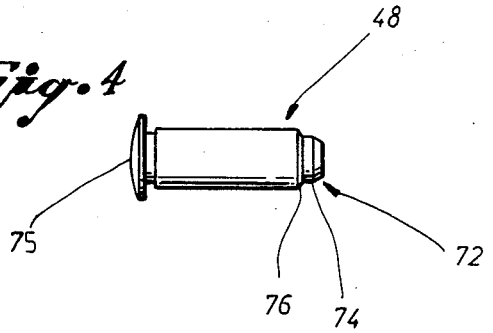
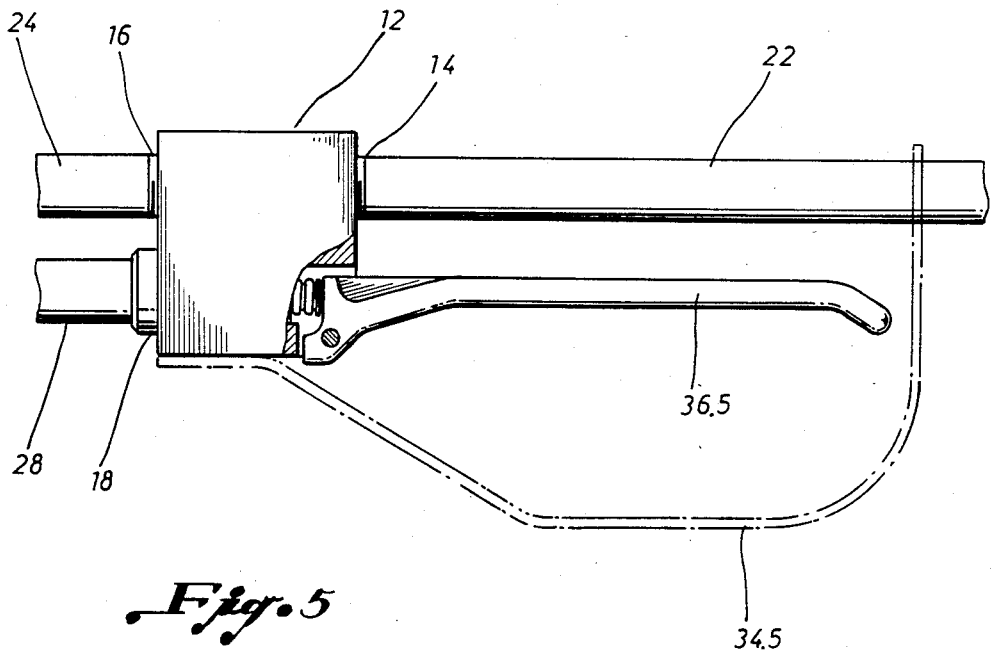
Fig. 5

FLUID CONTROL SYSTEM

FIELD OF THE INVENTION

This invention relates to a fluid control system. More particularly this invention relates to a high pressure fluid control system for handling high pressure fluids, to fluid control apparatus for use in such a system, and to components for use in such fluid control apparatus.

BACKGROUND OF THE INVENTION

Fluids at high pressure are used for various purposes. High pressure fluids are often used in high pressure streams in fluid blast systems for cleaning purposes. Such high pressure streams are, for example, used for cleaning surfaces, for cleaning unwanted coatings or deposits off surfaces particularly metal and concrete surfaces, and for cleaning the interior surfaces of vessels and tubes particularly to remove scale and other deposits.

High pressure fluid streams are generally controlled by meanas of a fluid control apparatus which includes a high pressure discharge outlet for discharging a high pressure fluid stream, a pressure relief low pressure dump outlet for relieving pressure when discharge of the high pressure fluid stream is to be discontinued, and a control valve arrangement for controlling flow between the high pressure discharge outlet and the low pressure or dump outlet.

High pressure fluid streams are often provided at pressure of between about 5,000 and about 20,000 p.s.i.a., and typically at about 10,000 p.s.i.a. for cleaning purposes. At these pressures the streams can be extremely hazardous.

To reduce the potential hazard of such streams, the fluid control apparatus is usually designed so that pressure flow through the high pressure discharge outlet can only continue while an actuating member is held in its operative position to thereby hold a valve closure member in its seated condition. As soon as the actuating member is released, the valve closure member will be unseated and the pressure will be relieved through the dump outlet for the high pressure fluid stream to drop to a low pressure.

Since these fluid control devices are usually mobile, hand held and manually actuated, it is highly desirable for the devices to require a small operating force to hold the valve member in its seated or closed position. However, because of the high pressures involved, a relatively large force is typically required to hold the valve member on its seat in order to prevent release of pressure through the dump outlet.

To overcome this high valve closure member seating force, rather complicated and costly actuating apparatus has been devised. Examples of these are the cam-assisted valve member actuator described in U.S. Pat. No. 3,672,575, Hinrichs, and the power-assisted and pilot-valve assisted apparatus described in U.S. Pat. No. 4,349,154.

Leakage through the dump outlet results in losing fluid pressure and flow in the high pressure system, and such leakage also usually allows the high pressure fluid to quickly erode the valve seat surface. The resulting seat damage requires that the fluid control apparatus be removed from service frequently and repaired. It is therefore highly desirable in this type device that a low, manageable valve member closing force be maintained.

The factors that generally determine the magnitude of the valve member closing force in this type of apparatus are the hydraulic areas on which the high pressure fluid acts in the closed or seated position of the valve element, and the axial alignment between the sliding valve member and its stationary seat.

Attempts have been made to reduce the effects of the valve member hydraulic areas through the use of a pilot valve that works in conjunction with a main valve member. However, a pilot valve introduces an additional high pressure seat into the apparatus, and results in a more complex assembly, higher manufacturing costs, and generally greater field maintenance requirements for the apparatus.

Other attempts to overcome the effects of the valve member hydraulic areas have been to utilize a single element valve closure member with various special seating configurations. However, these constructions fail to take into consideration the hydraulic effects that variances in the closure member's trailing end high pressure seal can have on the closure member forces. Such single element structures also have been prone to wide variations in hydraulic forces due to sealing area wear during use.

The axial alignment between the sliding valve element and its seat is considered to be quite critical to the magnitude of the operating force that is required to keep the valve element in its closed or seated position. This is because a very precise coaxial mating condition is required to provide an effective metal-to-metal seal between the valve element and seat, particularly in the presence of high fluid pressures. In the fluid control apparatus now being used, the alignment between the sliding valve member and its seat is very difficult to maintain because each of these members operate with diametral clearance within separate bores in the valve body. The diametral clearance between the valve member and its bore, and between the seat and its bore, allows each member to become laterally displaced with respect to each other during operation. Because the seating surfaces on the valve member and its seat have corresponding tapers, the lateral displacement condition can usually be overcome with additional closing force on the valve member. However, the requirement for use of additional closing force is contrary to the desirable low operating force level from the actuating means.

Any surface wear on the sliding valve member and its guiding bore in the body will allow even more lateral displacement or misalignment with respect to the seat, and an even greater closing force is required from the actuating means. When wear occurs, replacement of the valve member alone may not solve the problem. The new valve closure member will again be subject to misalignment. Only by replacing both the expensive valve body and the valve member will the valve member and seat alignment be restored to a like-new condition. This is not only costly but time consuming.

Still another problem encountered with these fluid control devices is that they require frequent field maintenance. In addition to surface wear on the valve closure member and its seal due to frequent opening and closing, damage to the precision seat surface frequently occurs when small grains of hard foreign matter such as rust or sand particles scratch the seat surface while being entrained in the high velocity flow stream that is produced across the seating surface at the instant when the closure member moves away from the seat to release the fluid pressure in the system. Once the seat surface is damaged, fluid erosion due to high pressure fluid leakage quickly enlarges the seat damage, the replacement of the closure member and its seat becomes necessary. Such repair is time consuming and usually requires a higher degree of skill than that possessed by the average control device operator.

It is accordingly a general object of the present invention to provide a new and improved fluid control device which is constructed and arranged to overcome or at least partly reduce the foregoing disadvantages with prior devices.

Another object of the present invention is to provide a new and improved hand-held or foot controlled fluid blast apparatus which requires a very low actuating force in operation.

Still another object of the present invention is to provide a new and improved fluid blast control apparatus that is easier, faster and less expensive to repair and overhaul in the field.

SUMMARY OF THE INVENTION

These and other objects are attained in accordance with the concepts of the present invention through the provision of a fluid control system for use in a fluid blast system comprising:

(a) a body portion having an inlet for a source of fluid at high pressure, a discharge outlet for the discharge of fluid at high pressure, a dump outlet for the discharge of fluid at low pressure, and having a control chamber to place the dump outlet in communication with the inlet and the discharge outlet;

(b) a valve guide housing removably positioned in the flow chamber, the valve guide housing having a housing bore for housing a valve closure member, guide means for guiding such a valve closure member during displacement thereof relatively to the valve guide housing, and a valve seat; and (c) a valve closure member housed in the housing bore, the valve closure member having a closure seat, and being adapted to be displaced relative to the valve guide housing into a closed position where the closure member engages the seat to control flow through the dump outlet.

In a preferred embodiment of the invention opposing faces of the seat and closure member are shaped to provide substantially line contact between them when the valve closure member is in its closed position. This line contact serves to precisely define the hydraulic area and therefore the hydraulic force acting on the seating end of the valve closure member.

In one example of this embodiment of the invention the opposing faces of the valve member and the closure seat may be defined by annular seat surfaces which are at differing inclinations to the housing bore axis so that the annular edge portion of one seat makes substantial line contact with the annular seat surface of the other seat.

In the above-mentioned example, the annular seat surface of the valve member may be formed at a greater angle with respect to the longitudinal axis of the housing bore that the angle of inclination of the annular seat surface. This construction provides an annular outer edge that extends around the periphery of the closure member face. Such edge will make contact with the seat surface when the valve member is closed, thereby ensuring that the pressure of fluids within the control chamber cannot act on the entire leading end area of the valve member, but rather only on the precisely defined outside diameter of the valve member seat surface.

An annular seal means is provided between the trailing or rearward end of the valve member and the surrounding portion of the guide housing to prevent leakage of fluids in the rearward direction past the valve element. In a preferred embodiment, this seal means is located in a groove in the guide housing wall and sealingly engages an external surface of the valve member when the valve member is closed. Thus, the hydraulic force acting on the valve member at its trailing end also is precisely defined by its outer diameter at the point that the sealing means engages it.

This construction has the important advantage that fluid pressure within the control chamber during use of the present invention acts on very defined and controlled transverse cross-section areas of the valve member so that the force required to close the valve member during use is the difference between the hydraulic force acting on its seat end and the hydraulic force acting on its trailing end. In the preferred embodiment, the transverse cross-sectional area of the trailing end of the valve member is made slightly larger than the transverse cross-sectional area at the seating end to provide a resultant area on which the pressure of fluid can act to produce a bias force that tends to shift the valve element toward open position.

It is highly desirable to maintain the above-mentioned precisely defined hydraulic areas because of the low valve actuating force that is desired and the high fluid pressures that present during use. For example, each one-thousandth (0.001) of a square inch of area differential creates a corresponding 10 pounds of valve actuating force at an operating pressure of 10,000 psi. In use of the preferred embodiment of the present invention, the actuating force usually is held within plus or minus 5 pounds.

The present invention has the further advantage that the critical sealing hydraulic area and the critical seating hydraulic area are both defined by diameters that are maintained on a single element of the combination, viz., the valve member, and not on two or more elements as in some prior art devices. This constructional feature provides an important advantage in the economics of manufacturing the apparatus, as well as in the practical ease of acquiring the critical hydraulic differentials that are required for the manageable and desirable closing forces.

In the preferred embodiment, the valve seat is integral with the guide housing to permit the housing bore that guides the valve member to be machined in one machining set-up operation. This construction has the advantage that precise axial alignment between the guide bore and the seat can be readily obtained during manufacture, and the further advantage that once such axial alignment is achieved, it can never be altered or misaligned in the field.

The valve member of this embodiment preferably has a one-piece construction to allow for similar precise coaxial alignment between the valve seat surface and the trailing seal surface to be achieved during manufacture. Since the valve element is guided within the housing bore, coaxial alignment of the critical surfaces is readily achieved and maintained, so that the present invention provides very definite advantages over prior devices.

In certain prior fluid blast control apparatus, the valve element is guided within a bore of the body portion of the apparatus, while the valve seat is contained within still another bore in the body. Precise axial alignment between the valve member and its seat is difficult to achieve and maintain in such devices, because the valve body introduces another part that requires precision machining. The necessary diametral clearances between the valve element and the bore that contains it provides another opportunity for possible misalignment.

A bias spring may be included to be operative between the valve closure member and the valve guide housing to bias the valve closure member toward an open position even in the absence of fluid under pressure within the control chamber.

In an embodiment of the invention, the valve guide housing is generally tubular having a leading end portion where the valve seat is provided, having a trailing end at the other end, and having the housing bore extending from the leading end to the trailing end.

In this embodiment the valve guide housing has a flow opening intermediate its ends to place the housing bore in communication with the flow chamber.

In this embodiment of the invention, the control chamber has walls defining a tubular zone where the valve guide housing is removably positioned, with the valve guide housing sealingly engaged with the walls defining the tubular zone in sealing zones provided on opposed sides of the flow opening means, and with the control chamber being shaped for the inlet and the discharge outlet to communicate with the tubular zone in a throat portion between the sealing zones.

In this embodiment of the invention the valve guide housing is preferably shaped between the sealing zones to present substantially corresponding opposed surface areas in the direction of the leading end and in the direction of the trailing end respectively when the valve closure member is in its closed position to limit any resultant axial force produced by fluid pressure during use tending to displace the valve guide housing axially.

This construction has the advantage that no substantial resultant axial force will be imposed on the valve guide housing when the valve closure member is in its closed position and maximum pressure therefore prevails in the control chamber. Once the valve closure member is displaced out of its closed position, the pressure will drop in the control chamber and the need for pressure balancing of the valve guide hosuing will therefore tend to fall away when the valve closure member is not in its closed position.

This pressure balancing of the valve guide housing can provide the advantage that the valve guide housing can be sealed in position in the control chamber without the need for heavy or substantial fittings, and that these components of the apparatus could be assembled or disassembled without the need for using tools such as wrenches or the like.

The apparatus preferably includes actuating means which is adapted to be actuated by an operator of the apparatus to displace the valve closure member relatively to the valve guide housing toward its closed position and to maintain it in its closed position.

The actuating means may be of any suitable or conventional type which is operated manually or by foot.

The apparatus may include a dump nozzle for discharging fluid at low pressure, the dump nozzle being removably connected to the dump outlet.

In a preferred embodiment of the invention the dump nozzle may have the valve guide housing removably connected to a trailing end thereof. It may be so connected by any suitable means such as, for example, complementary connection flanges and socket formations or the like that would allow for the guide housing together with the valve member, bias spring, and all guide housing seals to be quickly and conveniently removed from the assembly by simply removing the dump nipple and extracting the above parts from the body as the nipple is removed.

This construction has the advantage that all critical wear parts in the apparatus can be quickly and easily replaced in the field. Another advantage of this construction is that the guide housing, valve member, bias spring and seals can be supplied to the user of the apparatus as a complete unit or assembly to enable the user to replace the same in a preassembled condition.

The invention further extends to a method of accurately controlling the closing force required to keep a valve closure member in its closed position in a fluid blast control apparatus of the type described herein, which method comprising:

(a) providing sealing means in the guide bore to cooperate sealingly with the valve closure member during use;

(b) shaping the annular closure seat to make substantially line contact with the annular valve seat; and (c) providing a bias shoulder outwardly of the line contact zone of the closure seat to provide the sole bias surface on which fluid can act during use to provide a bias force biasing the valve closure member towards its open position when it is in its closed position, the bias surface being accurately determined to provide a desired bias force which remains directly proportional to fluid pressure during use.

The apparatus and methods of this invention may be used in various applications where fluid flow, particularly high pressure fluid flow, is to be controlled between a high pressure inlet, a high pressure outlet and a pressure relief or low pressure or dump outlet. This invention does, however, have particular application where high pressure fluid flow is to be controlled manually or physically by an operator, and where the apparatus is designed so that, for safety purposes, a high pressure fluid discharge can only continue as long as a valve closure member leading to a low pressure, relief or dump outlet is maintained in its closed position by physical force applied by an operator. The invention therefore has particular and specific application in regard to fluid blast control systems where fluid blast such as high pressure streams of water or other liquids are used for cleaning purposes. Such high pressure liquid blasts are typically used for cleaning unwanted deposits or coatings off surfaces such as metal surfaces, concrete surfaces and the like, or off surfaces within vessels or tubes.

Fluid blast control apparatus may be used with a fluid blast high pressure nozzle which extends from the apparatus to generate a high pressure liquid stream. Alternatively, such apparatus may be used in a remote configuration where a high pressure discharge nozzle can be fed into a vessel or tube, and is supplied with high pressure fluid from a remote control apparatus.

The operative components of the apparatus of this invention may be made of any conventional materials which are suitable for the operating conditions and pressures to be accommodated during use.

In a preferred embodiment of the invention, the valve seat and closure seat of the components of the apparatus may be made of stainless steel, preferably a high carbon stainless steel which is heat treated such as stainless steel grade 17-4PH or grade 4-40C, for example.

BRIEF DESCRIPTION OF THE DRAWINGS

Preferred embodiments of the invention are now described by way of example with reference to the accompanying drawings.

In the drawings:

FIG. 1 shows a fragmentary partly sectional side elevation of a fluid blast control apparatus in accordance with this invention, in the form of a water blast gun;

FIG. 3 shows, to an enlarged scale, a partly sectional side elevation of the valve guide housing of the water blast gun of FIG. 1;

FIG. 4 shows a side elevation of the valve closure member of the water blast gun of FIGS. 1 and 2;

FIG. 5 shows a fragmentary partly sectional side elevation of an alternative embodiment of a water blast gun in accordance with this invention, having a lever arrangement for operating the gun; and FIG. 6 shows a partly sectional side elevation of yet a further alternative embodiment of the water blast gun of FIG. 1, in the form of a foot operated model.

DETAILED DESCRIPTION OF PREPARED EMBODIMENTS

Figure 2:
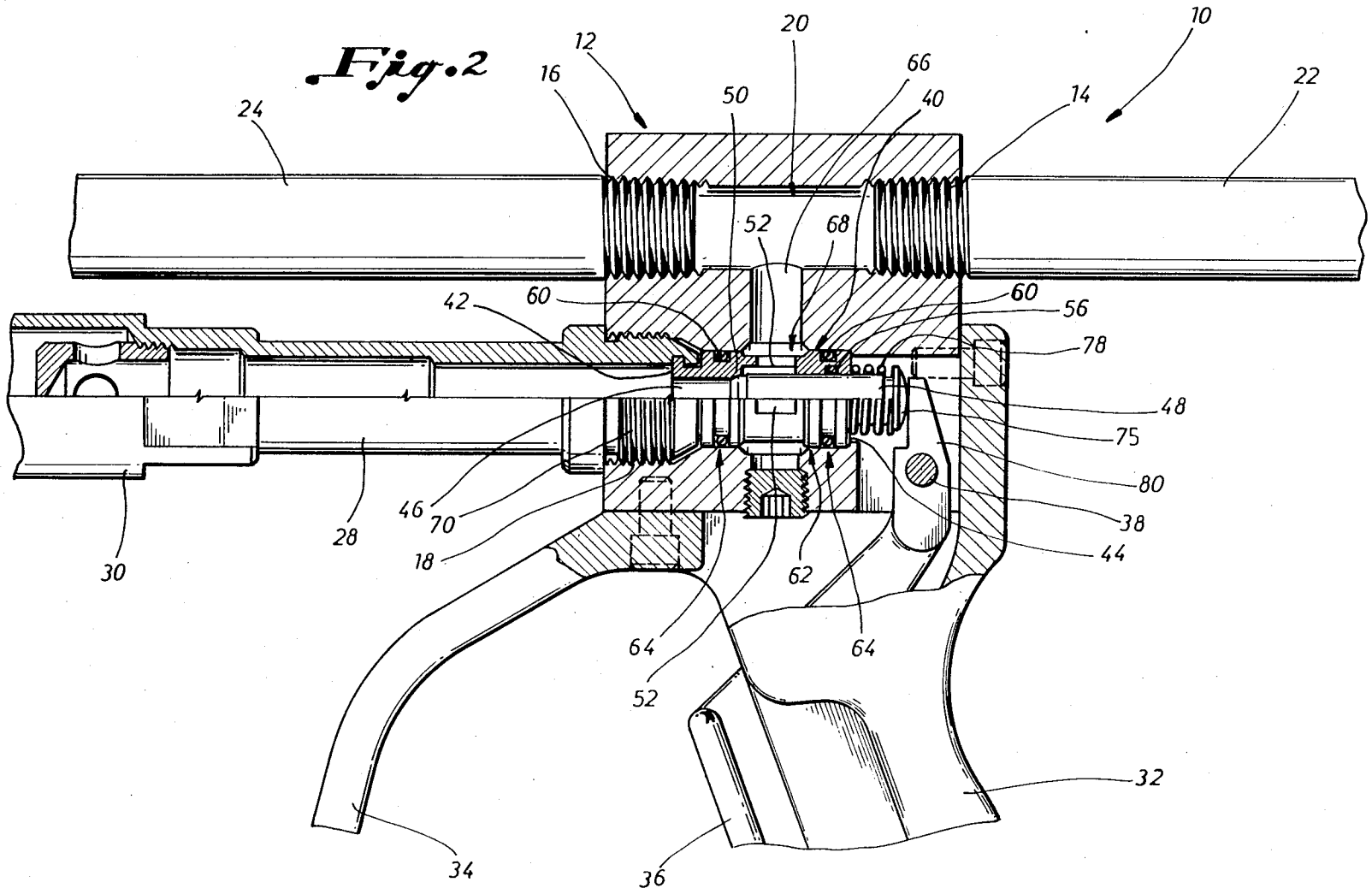
FIG. 2 shows, to an enlarged scale, a fragmentary partly sectional view of the water blast gun of FIG. 1.

With reference to FIGS. 1 to 4 of the drawings, reference numeral 10 refers generally to a fluid blast control apparatus in accordance with a preferred embodiment of this invention, in the form of a water blast gun.

The water blast gun 10 comprises a body portion 12 having an inlet 14 for a source of water at high pressure, having a discharge outlet 16 for the discharge of water at high pressure, having a dump outlet 18 for the discharge of water at low pressure, and having a flow chamber 20 and a control chamber 68 within the body portion 12 to place the dump outlet 18 in communication with the inlet 14 and with the discharge outlet 16.

The water blast gun 10 is shown having an inlet nipple 22 removably connected to the inlet 14. The inlet nipple 22 has rearward end (not shown) adapted for connection to a source of water at high pressure. The source of water at high pressure is typically provided by a suitable and conventional high pressure pump.

The water blast gun 10 is further shown having a high pressure discharge nipple 24 removably connected to the discharge outlet 16. The discharge nipple 24 has a discharge nozzle 26 mounted at its outer end for providing a jet or stream of water at high pressure during use for cleaning surfaces and the like.

The water blast gun 10 is further shown having a dump nozzle 28 removably mounted in the dump outlet 18. The dump nozzle 28 has a diffuser 30 mounted at its outer end for discharging water at low pressure from the dump nozzle 28 when the high pressure stream from the discharge nozzle 26 is to be interrupted during use.

Each of the inlet 14, outlet 16 and dump outlet 18 is conveniently provided with a threaded bore so that the inlet nipple 22, the discharge nipple 24 and the dump nozzle 28 can be threaded into the threaded bores to thereby mount them in position on the body portion 12.

The water blast gun 10 further has a handle 32 connected to the body portion 12. The handle 32 includes a trigger guard 34. A trigger 36 is pivotally mounted on the body portion 12 by means of a pivot pin 38.

The water blast gun 10 has a valve guide housing 40 removably positioned in the control chamber 68.

As can be seen more specifically in FIG. 3, the valve guide housing 40 is generally of tubular configuration, having a leading end portion 42 at one end, having a trailing end portion 44 at the opposed end, and having a housing bore 46 extending through the housing 40 from the leading end portion 42 to the trailing end portion 44 for slidably receiving a valve closure member 48 (as shown particularly in FIG. 4 and FIG. 2).

The valve guide housing 40 has an annular valve seat 50 provided within the housing bore 46. The annular valve seat 50 is inclined to the axis of the housing bore 46 at an acute angle. In the presently preferred embodiment of the invention, the angle is preferably about 30°.

The valve guide housing 40 has flow opening means in the form of flow openings 52 provided in an intermediate region of the housing 40 between the leading and trailing end portions 42 and 44 to lead flow into the housing bore 46 during use.

The valve guide housing 40 has an internal annular recess 54 proximate its trailing end portion 44 wherein an annular seal 56 (FIGS. 1 and 2) is positioned for cooperating sealingly and slidably with the valve closure member 48. The annular seal 56 has been omitted from FIG. 3 for the sake of clarity.

The valve guide housing 40 has an external annular recess 58.1 between the leading end portion 42 and the flow openings 52, and has an annular recess 58.2 between the flow openings 52 and the trailing end portion 44. An annular sealing ring 60 is provided in each annular recess 58.1 and 58.2 to provide annular sealing surfaces on opposed sides of the intermediate zone of the valve guide housing 40 wherein the flow openings 52 are provided.

The annular sealing rings 60 are shown in FIGS. 1 and 2 but have been omitted from FIG. 3 for the sake of clarity.

The control chamber 68 has a tubular zone 62 which extends inwardly from the dump outlet 18 and is in line therewith.

The tubular zone 62 is generally of complementary shape to the valve guide housing 40 for removably locating the valve guide housing 40 in position in the flow chamber 20 as shown in FIGS. 1 and 2.

Because the tubular zone 62 is in line with the dump outlet 18, the valve guide housing 40 may be inserted into the tubular zone 62 through the dump outlet 18, and may be withdrawn from the tubular zone 62 for repair or replacement through the dump outlet 18.

The tubular zone is shaped to have a pair of laterally spaced annular sealing surfaces 64 which engage sealingly with the annular sealing rings 60 to locate the valve guide housing 40 in a sealed condition in the tubular zone 62.

The flow chamber 20 has a throat portion 66 which leads to the enlarged annular zone of the control chamber 68 which corresponds with the intermediate region of the valve guide housing 40 between the pair of annular sealing rings 60. The throat portion 66 therefore places the control chamber 68 in communication with the inlet 14 and the discharge outlet 16.

The enlarged annular zone in the control chamber 68 will, during use, lead water under pressure from the inlet 14 through the flow openings 52 into the housing bore 46.

The annular sealing rings 60 confine any pressure exerted by water under pressure in the control chamber 68 to the zone between the annular sealing rings 60.

The valve guide housing is shaped so that when the valve closure member 48 is located in its closed position (as shown in FIGS. 1 and 2) any forces generated on the valve guide housing 40 by the water pressure in the direction of the leading end portion 42 of the valve guide housing 40, will be substantially balanced by the forces generated in the direction of the trailing end portion 44.

While the valve closure member 48 is as in its closed position, the valve guide housing 40 will be substantially pressure balanced with no significant resultant axial force either in the direction of the leading end portion 42 or in the direction of the trailing end portion 44.

This arrangement provides the advantage that heavy port fittings are not required to maintain the valve guide housing 40 in position in the tubular zone 62. Instead, conventional threads are provided in the threaded bore of the dump outlet 18. The dump nozzle 28 has a threaded trailing end 70 which engages in the threaded bore of the dump outlet 18, and is sufficient to retain the valve guide housing 40 in position in the tubular zone 62.

When the valve closure member 48 is displaced into its open position, the valve guide housing 40 will no longer be completely pressure balanced. This is not a significant disadvantage, however, since the pressure within the control chamber 68 will drop significantly once the dump outlet 18 is open to discharge water at low pressure through the dump nozzle 28.

The valve closure member 48 is in the form of an elongated rod which has a closure seat 72 at its leading end to cooperate with the annular valve seat 50, and has a head 75 at its trailing end.

The valve closure member 48 is slidably located in the housing bore 46 for axial displacement therein between a closed position as shown in the drawings, and an open position where the closure seat 72 is spaced from the annular valve seat 50 to permit the relief of pressure and the dumping of water through the dump outlet 18.

The closure seat 72 is in the form of an annular seat which is inclined to the axis of the valve closure member 48 at an angle at about 31 degrees.

The angle differential of 1 degree between the angle of inclination of the annular closure seat 72 and the annular valve seat 50 defines an annular edge zone 74 along the outer periphery of the closure seat 72, which engages the annular valve seat 50 when the valve closure member is in its closed position, for the annular edge zone 74 to make line contact with the annular valve seat 50.

Because the annular edge zone 74 makes line contact with the annular valve seat 50, it absolutely defines the surface area of the valve closure member 48 which is positioned beyond or outwardly of the annular edge zone 74. In addition, of course, when the valve closure member is in its closed position, the annular edge zone 74 will accurately prevent any fluid pressure action on the leading end of the valve closure member 48 within the confines of the annular edge zone 74. This arrangement provides a substantial advantage in the accurate control of an opening bias force as is hereinafter described. Even if the cooperating annular edge zone 74 and the annular valve seat 50 become worn to a limited extent during normal use, the contact between the closure seat 72 and the annular valve seat 50 should generally remain on the same radius as the annular edge zone 74. In other words, surface areas of the valve closure member which will be exposed to fluid pressure during use, will tend to remain substantially the same even when reasonable wear of the annular edge zone 74 has occurred during use. This is an important factor to insure a consistent opening bias force which biases the valve closure member 48 into its open position as discussed below.

The valve closure member 48 extends sealingly and slidably through the annular seal 56. The annular seal 56 therefore prevents fluid flow along the housing bore 46 through the trailing end portion 44 of the valve guide housing 40.

Since the annular seal 56 is provided in the housing bore 46, and the seal sealingly and slidably engages the valve member 48 on the outside diameter of the trailing end thereof, the transverse cross-sectional area which determines the hydraulic force on the valve member during use is precisely defined. If the seal 56 were to be mounted in a groove on the trailing end of the valve member 48, so that it would sealingly and slidably contact the inside diameter of the housing bore 46, then the transverse cross-sectional area which would determine the hydraulic force on the valve member would be calculated using the inside diameter of the housing bore. However, the applicant believes that since the inside diameter of a bore generally is more difficult to control during manufacture than the outside diameter of the rod-like valve member, he considers it to be preferable to mount the seal in a groove in the wall of the housing bore. Either arrangement should provide substantially the same result.

The valve closure member, as shown in FIG. 4, has an annular shoulder 76 which is formed by a stepped formation proximate the leading end of the valve closure member 48.

The annular shoulder 76 provides a surface transition on the valve closure member 48, which is outside the periphery of the annular edge zone 74, and which can provide a bearing surface against which fluid pressure within the fluid chamber 68 during use, can bear to provide a bias force for biasing the valve closure member 48 into its open position.

This bias force is provided as a safety feature to ensure that unless the valve closure member 48 is physically held in its closed position, fluid pressure within the control chamber 68 will force the valve closure member 48 into its open position thereby relieving pressure in the control chamber 68 by dumping water at low pressure through the dump outlet 18. This has the effect of reducing the pressure within the discharge nipple 24 and thereby reducing the force with which a jet of water emerges from the discharge nozzle 26.

In the presently preferred embodiment of the invention the annular shoulder 76 provides a surface area differential of about two thousandths of an inch. Therefore at a water pressure of about 10,000 p.s.i.a., the bias force would typically be in the region of about ten to twenty pounds. A small variation in the surface area exposed to pressure can therefore significantly affect the bias force.

The valve closure member 48 is slidably located in the housing bore 46. It is therefore accurately guided for displacement by guide means in the form of the walls defining the housing bore 46 on the trailing side of the annular valve seat 50.

This arrangement provides the advantage that the valve closure member 48 will be guided accurately during displacement thereby ensuring accurate alignment of the annular edge zone 74 with the annular valve seat 50 during use.

This arrangement provides the further advantage that if the corresponding seating surfaces become worn during use, and need to be reground, the seating surfaces can be reground by conventional means while the valve closure member is located in the housing bore 46 thereby ensuring that proper alignment is maintained during regrinding.

The replaceable valve guide housing 40 provides the further advantage that no sliding surfaces which are subjected to sliding wear are provided in the body portion 12. The only sliding surfaces are those of the housing bore 46 and the outer surface of the valve closure member 48.

If the surface of the valve closure member 48 wears, the valve closure member 48 can readily be replaced in the valve guide housing 40.

If the housing bore 46 of the valve guide housing 40 wears, the valve guide housing 40 (and the valve closure member 48 if necessary) can readily be replaced without replacement of the entire body portion 12 being required.

This provides the advantage that it reduces the cost of maintenance and replacement. This can provide the further advantage that replacement of the valve guide housing 40 would tend to be done sooner than replacement of the body portion 12 thereby ensuring that maintenance is effected soon after leakage commences, instead of greater physical pressure being applied to the trigger 36, and particularly instead of mechanical means being utilized to hold the trigger 36 in its operative condition. Such mechanical means would of course defeat the safety objectives of the blast gun 10.

A bias spring 78 is mounted on the valve closure member 48 to be operative between the head 75 and the trailing end portion 44 of the valve guide housing 40. The spring 78 provides a limited bias force to bias the valve closure member 48 into its open position when there is insufficient control pressure within the fluid chamber 68 to do so.

The trigger 36 is in the form of a lever arrangement having a leading end 80 which abuts the head 75. When the trigger 36 is actuated manually, the end 80 will depress the head 75 and thus displace the valve closure member 48 into its closed position. Because of the bias force as previously discussed, the valve closure member will remain in its closed position only while the trigger 36 is depressed.

The trigger 36 in the presently preferred embodiment, provides a mechanical advantage of about 5 to 1. The trigger force to maintain the valve closure member 48 in its closed position will therefore generally be between about 2 and about 4 pounds.

The valve guide housing 40 is provided with an annular connection flange 84 at the leading end portion 42. The threaded trailing end 70 of the dump nozzle 28 is provided with a complementary semiannular connection flange 86 at its trailing end.

The valve guide housing 40 is removably connected to the dump nozzle 28 by displacing the housing 40 and nozzle 28 towards each other in a direction transversely to their axes to engage the annular connection flange 84 with the semiannular connection flange 86. The valve guide housing 40 and dump nozzle 28 are thus axially connected as shown in FIGS. 1 and 2. A spring biased ball may be provided to prevent inadvertant separation by restraining relative movement transversely to the axis.

When the valve guide housing 40 is to be removed from the water blast gun 10, the dump nozzle 28 may be unscrewed and withdrawn from the dump outlet 18 to thereby simultaneously withdraw the valve guide housing 40 and the valve closure member 48 from the tubular zone 62. To insert a fresh valve guide housing 40, it may be clipped to the dump nozzle 28, and may then be inserted in the same way.

For convenience of repair, the guide house 40, valve member 48, bias spring 78, and seals 56 and 60 can be supplied to the user of the apparatus as a unitary assembly to enable the user to completely over-haul the water blast gun 10.

Because of the pressure balanced valve guide housing 40, the dump nozzle 28 may be simply screwed into the dump outlet 18 by hand, and may be unscrewed by hand without the need to use wrenches or the like. This will again facilitate maintenance and replacement during use.

In FIG. 5 an alternative embodiment of a water blast gun in accordance with this invention is shown. The gun corresponds substantially with the gun 10 illustrated in FIGS. 1 and 2 except that in place of the trigger 36 a lever arrangement 36.5 has been provided. In addition the handle 32 has been omitted and the trigger guard 34 has been replaced by a trigger guard 34.5 which is engaged with the inlet nipple 22. The lever arrangement 36.5 is operated in exactly the same fashion as the trigger 36.

With reference to FIG. 6 of the drawings, yet a further alternative embodiment of a water blast gun apparatus in accordance with this invention.

The water blast apparatus corresponds essentially with the water blast apparatus 10 of FIGS. 1 and 2, except that the apparatus is in the form of a foot operated model. The apparatus is therefore mounted on a base plate 90 and the trigger 36 has been replaced by a foot operated pedal 36.6.

An adjustable capscrew 92 can be provided to adjust the extent to which the pedal 36.6 can be depressed.

U-shaped protective frame members 94 are mounted on the base plate 90 to protect the pedal 36.6 against inadvertent actuation. A tee junction 96 is shown mounted in position in the high pressure discharge outlet 16. The tee junction 96 allows the water blast apparatus to be installed in series in a high pressure hose string that runs between the high pressure pump and the blasting nozzle.

It now will be recognized that a new and improved water blast apparatus has been disclosed. Since certain changes or modifications may be made in the disclosed embodiments without departing from the inventive concepts involved, it is the aim of the appended claims to cover all such changes and modifications falling within the true spirit and scope of the present invention.

I claim:

1. Fluid blast control apparatus for use in controlling a high pressure fluid and a fluid blast system, the apparatus comprising:

(a) a body having an inlet for a source of fluid at high pressure, a discharge outlet for the discharge of fluid at high pressure, a dump outlet for the discharge of fluid at low pressure, and a control chamber to place the dump outlet in communication with the inlet and the discharge outlet, said control chamber being defined in part by a bore extending within said body;

(b) a valve guide removably fixed against longitudinal movement in said body bore for receiving a valve closure member, said guide having means for guiding a valve closure member during displacement thereof relatively along said guide means, and having a valve seat; and (c) a valve closure member slidably received in said guide means, said valve closure member having a closure surface, said valve closure member being adapted to be displaced relative to said guide into a closed position where said surface engages said seat to control flow through said dump outlet.

2. Apparatus according to claim 1, in which said valve seat and said surface are shaped to provide substantially line contact between them when the valve closure member is in its closed position.

3. Apparatus according to claim 2, in which the valve seat and said surface are defined by conical surfaces which are at differing inclinations to the axis of said guide so that an annular edge of one of said conical surface makes substantial line contact with the other of said conical surfaces.

4. Apparatus according to claim 3, in which the conical surface of said closure member is at a greater angle to the guide axis than the conical surface of the valve seat to define said annular edge along the outer periphery of the conical surface of the closure member.

5. Apparatus according to claim 2, in which the valve seat comprises an annular valve seat surface which is inclined with respect to the axis of said guide, and in which said closure member surface comprises an annular edge along the periphery of the valve closure member proximate a leading end thereof to provide substantial line contact with said annular valve seat surface when the valve closure member is in its closed position.

6. Apparatus according to claim 5, in which the valve guide has a leading end portion where the valve seat is provided, a trailing end portion, and an intermediate portion in which flow openings are provided to place the bore of said guide in communication with said control chamber.

7. Apparatus according to claim 6, in which seal means is provided between a trailing end portion of the valve closure member and said trailing end portion of said guide to prevent leakage of fluid out of said trailing end portion of said guide.

8. Apparatus according to claim 7, in which said seal means comprises an annular seal provided in an annular recess in a wall defining said guide bore.

9. Apparatus according to claim 8, in which an outwardly extending shoulder is provided on said valve closure member for fluid pressure during use to act on and provide a bias force to bias the valve closure member toward an open position.

10. Apparatus according to claim 9, in which a bias spring reacts between said valve closure member and said valve guide to bias said valve closure member toward an open position.

11. Apparatus according to claim 1, in which the valve seat is integral with said valve guide.

12. Apparatus according to claim 1, in which said valve guide is tubular and has a leading end adjacent said valve seat, and a trailing end opposite said leading end, said guide bore extending from said valve seat to said trailing end and opening therethrough.

13. Apparatus according to claim 12, in which said valve guide has flow opening means intermediate its leading and trailing ends to place said guide bore in communication with said control chamber.

14. Apparatus according to claim 13, in which said control chamber has walls defining a tubular zone where said valve guide is positioned, said valve guide being sealingly engaged with the walls defining the tubular zone in sealing zones provided on opposed sides of said flow opening means.

15. Apparatus according to claim 14, in which said valve guide is shaped so that said sealing zones are formed on substantially the same diameter to limit any resultant axial force produced by fluid pressure during use tending to displace the valve guide axially of said body bore.

16. Apparatus according to claim 1, including actuating means which is adapted to be actuated by an operator of the apparatus to displace said valve closure member relative to said valve guide toward its closed position.

17. Apparatus according to claim 16, in which the actuating means includes a lever member to provide a mechanical advantage.

18. Apparatus according to claim 17, in which the lever member comprises a trigger to be operated manually.

19. Apparatus according to claim 17, in which the lever member is adapted to be operated by foot.

20. Apparatus according to claim 1, in which said body bore extends from said dump outlet, and in which said valve guide may be inserted into and withdrawn from said body bore through the dump outlet.

21. Apparatus according to claim 20, including a dump nozzle for discharging fluid at low pressure, said dump nozzle being removably connected to said dump outlet.

22. Apparatus according to claim 21, in which said dump nozzle and said valve guide are removably connected to one another by connection means.

23. Apparatus according to claim 22, in which said connection means comprises an annular flange on said valve guide that has a complementary connection with an annular flange on said dump nozzle.

24. Apparatus according to claim 23, in which one of said annular flanges comprises a substantially semi-circular lip engaging with the other of said annular flanges so that said other flange may be disengaged for said lip by displacing said nozzle and valve guide relative to each other in a direction transversely of their axes.

25. Apparatus according to claim 1, further including a fluid blast nozzle removably connected to said discharge outlet for providing a high pressure fluid blast stream during use.

26. Valve means adapted to be removably fixed in a fluid blast control apparatus for use in controlling a high pressure fluid in a fluid blast system, the apparatus including a body having an inlet for connection to a source of fluid at high pressure, a discharge outlet for the discharge of fluid at high pressure, a dump outlet for the discharge of fluid at low pressure, and a chamber to place the dump outlet in communication with the inlet and the discharge outlet; said valve means comprising a generally cylindrical valve guide defining a valve seat and a passage leading to the dump outlet, said passage providing a guide bore;

a valve closure member slidably received in said guide bore, said valve closure member having a front face arranged to make substantially line contact with said valve seat when the valve closure member is in its closed position, said valve member having a trailing end;

coengageable means on said valve guide and said trailing end arranged to form a seal to resist fluid flow in a trailing direction out of the guide bore; and an outwardly directed shoulder on said valve closure member arranged to present a surface on which fluid pressure can act during use to provide a biasing force to bias the valve closure member towards a open position.

27. Apparatus according to claim 26, in which said front face is shaped to define an annular edge along a peripheral zone of the valve closure member for making line contact with said valve seat thereby ensuring that no surface portion of said valve closure member within said annular edge can present a surface on which fluid pressure can act when the valve closure member is in its closed position thereby limiting the biasing force specifically to the force generated during use on the surface presented by said outwardly directed shoulder.

28. Apparatus according to claim 27, in which said shoulder surface has a transverse cross-sectional area arranged to provide a biasing force on said valve closure member which is between about 5 and 20 pounds during use when a fluid pressure within said control chamber is about 10,000 p.s.i.a.

29. Fluid blast control apparatus for use in controlling a high pressure fluid in a fluid blast system, the apparatus comprising:

(a) a body having an inlet for connection to a source of fluid at high pressure, a discharge outlet for the discharge of fluid at high pressure, a dump outlet for the discharge of fluid at low pressure, and a control chamber for placing the dump outlet in communication with the inlet and the discharge outlet;

(b) said chamber having a tubular zone for removably receiving a valve guide which is generally tubular, said valve guide having a valve seat at one end and a bore leading from said seat to a trailing end portion thereof, said valve guide having flow opening means leading to said bore intermediate the ends, and a valve closure member positioned in said bore, said tubular zone having spaced sealing zones for engaging sealing with said valve guide on opposed sides of said flow opening means, said valve guide being shaped to provide an annular flow zone intermediate said sealing zones to lead fluid during use to said flow opening means from said inlet.

30. Fluid blast control apparatus for use in controlling a high pressure fluid in a fluid blast system, the apparatus comprising:

(a) a body having an inlet for connection to a source of fluid at high pressure, a discharge outlet for the discharge of fluid at high pressure, a dump outlet for the discharge of fluid at low pressure, and a control chamber to place said dump outlet in communication with said inlet and said discharge outlet; and (b) a valve guide removably fixed against sliding movement in said control chamber, said valve guide having a cavity for receiving a valve closure member, and guide means for guiding said valve closure member during displacement thereof relative to said valve guide, said guide having a valve seat arranged to cooperate with a companion closure surface of said valve closure member.

31. Apparatus according to claim 30, further including a valve closure member slidably received in said cavity, the valve closure member having a closure surface to cooperate with said valve seat.

32. Apparatus according to claim 31, in which the valve seat and the closure surface are shaped to make line contact with each other during use when said valve closure member is displaced into a closed position within said valve guide.

33. Fluid blast control apparatus for use in controlling a high pressure fluid in a fluid blast system, the apparatus comprising:

(a) a body portion having an inlet for connection to a source of fluid at high pressure, having a discharge outlet for the discharge of fluid at high pressure, having a dump outlet for the discharge of fluid at low pressure, and having a control chamber to place the dump outlet in communication with the inlet and the discharge outlet;

(b) a valve guide housing removably positioned in the flow chamber, the valve guide housing being generally tubular with a leading end at one end, a trailing end at the opposed end, and an elongated housing bore extending from the trailing end to the leading end, the valve guide housing having an annular valve seat proximate its leading end, having flow opening means intermediate its ends leading to the housing bore, and having valve sealing means between the flow opening means and the trailing end to engage sealingly with a valve closure member when positioned in the housing bore to resist fluid flow out of the trailing end of the housing bore during use;

(c) an elongated valve closure member slidably located in the housing bore for axial displacement therein between open and closed positions, the valve closure member having a closure seat complementary to the annular valve seat to cooperate therewith when the valve closure member is in its closed position to control flow through the dump outlet, the valve closure member having a trailing end portion which is engaged by the valve sealing means and which is guided by the walls defining the bore during displacement of the valve closure member;

(d) bias means for biasing the valve closure member towards its open position during use; and (e) actuating means which is adapted to be physically displaced into an operative position by an operator to displace the valve closure member into its closed position, and which is adapted to be held in its operative position by an operator against the action of the bias means during use to maintain the valve closure member in its closed position.

34. Apparatus according to claim 33, in which the closure seat is shaped to define an outer peripheral annular edge to make substantially line contact with the annular valve seat, in which the bias means is provided by annular shoulder means on the valve closure member on which fluid pressure can act during use, and in which the actuating means includes a lever member to be operated manually during use.

35. Fluid control apparatus for use in controlling a high pressure fluid, said apparatus comprising:

(a) a body having an inlet for a source of fluid at high pressure, a discharge outlet for the discharge of fluid at high pressure, a dump outlet for the discharge of fluid at low pressure, and a control chamber to place said dump outlet in communication with said inlet and said discharge outlet;

(b) a valve guide removably fixed against sliding movement in said flow chamber, said valve guide having a bore for receiving a valve closure member, said bore defining guide means for guiding a valve closure member during displacement thereof relative to said valve guide, said guide means having a valve seat;

(c) a valve closure member received in said bore, said valve closure member having a closure surface and being adapted to be displaced along said bore between an open position, and a closed position where said closure surface engages sealingly with said valve seat, said valve closure member having a specifically determined bias surface on which fluid pressure is adapted to act during use to provide a specific bias force to bias said valve closure member towards its open position; and (d) actuating means adapted to be actuated manually to displace said valve closure member into its closed position, said actuating means being adapted to be manually held to maintain said valve closure member in its closed position.

36. A valve guide for a fluid blast control apparatus of the type having a body with an inlet for a source of fluid at high pressure, a discharge outlet for the discharge of fluid at high pressure, a dump outlet for the discharge of fluid at low pressure, and a control chamber to place said dump outlet in communication with said inlet and said discharge outlet, said valve guide comprising (a) a tubular housing:

(i) having a leading end portion;

(ii) a trailing end portion;

(iii) and a bore extending between said leading and trailing end portions for slidably receiving a valve closure member that is adapted to be displaced in said bore relative to said tubular housing;

(iv) a rearwardly facing valve seat proximate said leading end portion to cooperate with a companion closure surface of a valve closure member; and (v) flow opening means intermediate said leading and trailing end portions to lead flow into said housing bore during use; and (b) said tubular housing being adapted to be removably positioned in said control chamber for use in controlling flow through said dump outlet and thus through said discharge outlet.

37. A valve guide according to claim 36, in which said tubular housing is in the form of an elongated tube having an elongated bore.

38. A valve guide according to claim 37, in which said bore has an internal annular recess proximate said trailing end for receiving a sealing ring to cooperate sealingly with a valve closure member when operatively located in said bore.

39. A valve guide according to claim 38, having a valve closure member positioned in said bore for displacement therein between a closed and an open position, said valve closure member having a closure seat adapted to cooperate with said valve seat, said valve closure member being shaped to be guided by walls defining said bore during displacement of said valve closure member between said open and closed positions.

40. A valve guide according to claim 39, in which said valve seat comprises a frusto-conical seat surface which extends at an acute angle to the axis of said housing bore, in which said valve closure member has a frusto-conical closure surface extending at a larger acute angle to the axis of said valve closure member to define an annular peripheral edge on said closure surface to provide substantial line contact with said seat surface when said valve closure member is in its closed position during use.

41. A valve guide according to claim 40, in which said valve closure member has a specific bias surface defined beyond the periphery of said annular peripheral edge, and against which fluid pressure can act during use when said valve closure member is in its closed position to provide a specific bias force for biasing said valve closure member towards its open position.

42. A valve guide according to claim 36, wherein said housing has annular sealing surfaces on opposite sides of the said flow opening means for engaging sealingly with walls defining said control chamber to thereby confine the location of fluid pressure in said control chamber during use on the guide housing to the surfaces of said guide housing that are located between said annular sealing surfaces.

43. A valve guide according to claim 42 wherein said sealing surfaces are on substantially the same diameter to provide a pressure-balanced condition.

44. A valve guide according to claim 36, having a valve closure member positioned in said bore for displacement therein between a closed and an open position, said valve closure member having a closure seat adapted to cooperate with said valve seat, said valve closure member being shaped to be guided by walls defining said bore during displacement of said valve closure member between said open and closed positions.

45. A valve guide according to claim 36, including connecting means adapted to be releasably engaged with a trailing end of a dump nozzle to be mounted in said dump outlet of said fluid blast control apparatus.

46. A valve guide according to claim 45, wherein said connecting means includes a connection flange adapted to be engaged with a complementary connection flange of a dump nozzle.

47. A dump nozzle having a trailing end portion to be mounted in a dump outlet of a fluid blast control apparatus of the type having a body with an inlet for a source of fluid at high pressure, a discharge outlet for the discharge of fluid at high pressure, a dump outlet to discharge fluid at low pressure, and a control chamber to place said dump outlet in communication with said inlet and said discharge outlet, said dump nozzle having a connection flange at said trailing end for releasably connecting a valve guide housing thereto to permit insertion and withdrawal of a valve guide housing with the said dump nozzle when its trailing end is inserted into or withdraw from a dump outlet, said valve guide housing having a leading and a trailing end and a bore extending between said ends for slidably receiving a valve closure member, said housing having a rearwardly facing seat proximate said leading end arranged to cooperate with a companion closure surface of a valve closure member, and flow opening means intermediate said ends, said housing having connecting means adapted to be releasably engaged with said connection flange.

48. A method of accurately controlling the closing force required to keep a valve closure member in its closed position in a fluid blast control apparatus of the type having a body portion with a high pressure inlet, a high pressure discharge outlet, a dump outlet, a flow chamber to place the dump outlet in communication with the inlet and the discharge outlet, an annular valve seat leading to the dump outlet, a valve closure member which is displaceable in the body portion and has an annular closure seat to cooperate with the annular valve seat when the closure member is displaced into a closed position, a guide bore housing a trailing end of the valve closure member to guide displacement thereof, and actuating means to be actuated manually to displace and then maintain the valve closure member in its closed position, the method comprising:

(a) providing sealing means which is axially located in the guide bore to cooperate sealingly with the valve closure member during use;

(b) shaping the annular closure seat to make substantially line contact with the annular valve seat; and (c) providing a bias shoulder outwardly of the line contact zone of the closure seat to provide the sole bias surface on which fluid can act during use to provide a bias force biasing the valve closure member towards its open position when it is in its closed position, the bias surface being accurately determined to provide a desired bias force which remains directly proportional to fluid pressure during use.

* * * * *